US009653045B2

(12) United States Patent
Asai

(10) Patent No.: US 9,653,045 B2
(45) Date of Patent: May 16, 2017

(54) MEMORY CONTROL DEVICE AND MOBILE TERMINAL

(71) Applicant: Sharp Kabushiki Kaisha, Osaka-shi, Osaka (JP)

(72) Inventor: Junki Asai, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 14/785,698

(22) PCT Filed: Mar. 28, 2014

(86) PCT No.: PCT/JP2014/059252
§ 371 (c)(1),
(2) Date: Oct. 20, 2015

(87) PCT Pub. No.: WO2014/174993
PCT Pub. Date: Oct. 30, 2014

(65) Prior Publication Data

US 2016/0078851 A1 Mar. 17, 2016

(30) Foreign Application Priority Data

Apr. 26, 2013 (JP) ..... 2013-094719

(51) Int. Cl.
*G09G 5/36* (2006.01)
*G09G 5/39* (2006.01)
(Continued)

(52) U.S. Cl.
CPC ..... *G09G 5/39* (2013.01); *G09G 5/005* (2013.01); *G09G 5/12* (2013.01); *G09G 5/18* (2013.01);
(Continued)

(58) Field of Classification Search
CPC ..... G09G 2360/18; G09G 5/393; G09G 5/39; G09G 2350/00; G09G 5/395; G09G 2360/12; H04N 7/0105
See application file for complete search history.

(56) References Cited

U.S. PATENT DOCUMENTS 7,336,317 B2 * 2/2008 Yui ..... G06F 3/14 348/459
8,355,587 B2 * 1/2013 Chen ..... G09G 5/36 382/232
(Continued)

FOREIGN PATENT DOCUMENTS

CN 1992816 A 7/2007
JP 2005-124167 A 5/2005
(Continued)

OTHER PUBLICATIONS

Official Communication issued in International Patent Application No. PCT/JP2014/059252, mailed on Apr. 28, 2014.

*Primary Examiner* — Hau Nguyen
(74) *Attorney, Agent, or Firm* — Keating & Bennett, LLP

(57) ABSTRACT

To prevent tearing in a case where image data is compressed to be written into a frame memory, the present invention includes (i) a compression section (33) for compressing image data for a single frame, the image data being transferred from a host processor (2), and writing the image data into a frame memory (31), (ii) an expansion section for reading image data, expanding the image data, and transferring the image data to an LCD (4), and (iii) a delay control section (32) for, until an inhibit time period Ts passes after the start of reading image data for a first frame, inhibiting the start of writing image data.

10 Claims, 12 Drawing Sheets

(51) Int. Cl.

| | |
|---|---|
| ***G09G 5/12*** | (2006.01) |
| ***G09G 5/18*** | (2006.01) |
| ***G09G 5/00*** | (2006.01) |
| *G09G 3/36* | (2006.01) |
| *G09G 5/393* | (2006.01) |

(52) U.S. Cl.
CPC ..... *G09G 3/3611* (2013.01); *G09G 5/393* (2013.01); *G09G 2320/0247* (2013.01); *G09G 2340/02* (2013.01); *G09G 2340/0435* (2013.01); *G09G 2360/128* (2013.01); *G09G 2360/18* (2013.01)

(56) References Cited

U.S. PATENT DOCUMENTS

| | | | |
|---|---|---|---|
| 2005/0105001 | A1 | 5/2005 | Yui et al. |
| 2006/0034326 | A1 | 2/2006 | Anderson et al. |
| 2006/0161691 | A1 | 7/2006 | Katibian et al. |
| 2006/0164424 | A1 | 7/2006 | Wiley et al. |
| 2006/0168496 | A1 | 7/2006 | Steele et al. |
| 2006/0171414 | A1 | 8/2006 | Katibian et al. |
| 2006/0179164 | A1 | 8/2006 | Katibian et al. |
| 2006/0179384 | A1 | 8/2006 | Wiley et al. |
| 2006/0288133 | A1 | 12/2006 | Katibian et al. |
| 2007/0146810 | A1 | 6/2007 | Kubo et al. |
| 2008/0036631 | A1 | 2/2008 | Musfeldt |

FOREIGN PATENT DOCUMENTS

| | | | |
|---|---|---|---|
| JP | 2007-178851 | A | 7/2007 |
| JP | 2010-026394 | A | 2/2010 |
| JP | 2011-041290 | A | 2/2011 |
| JP | 2011-158532 | A | 8/2011 |
| JP | 2014-052548 | A | 3/2014 |

* cited by examiner

《CASE OF HOST BEING SLOW》

《CASE OF HOST BEING SLOW 》

《CASE OF HOST BEING FAST》

《CASE OF HOST BEING FAST》

《CASE OF HOST BEING SLOW》

FIG. 9

| No | RATE DIFFERENCE | COMPRESSION METHOD | TE CONTROL | NORMAL CASE | | CASE OF $\alpha$ = 41/24, $\beta$ = 3/24 | | OUTPUT DELAY (Outdly) |
|---|---|---|---|---|---|---|---|---|
| | | | | NECESSARY EXTRA MEMORY (Va) | CRITICAL TIME PERIOD | NECESSARY EXTRA MEMORY (Va) | CRITICAL TIME PERIOD | |
| 1 | HOST BEING SLOW LCD BEING FAST Tin > Tout | UNCOMPRESSED | NO | 0 | NONE | 0 | NONE | Tin−Tout |
| 2 | | COMPRESSED | NO | $\left(\alpha\frac{T_{out}}{T_{in}}-\beta\right)\frac{\alpha-1}{\alpha-\beta}V_{size}$ | NONE | $\left(0.764\frac{T_{out}}{T_{in}}-0.056\right)V_{size}$ | NONE | Tin−Tout |
| 3 | | | YES | 0 | $\frac{\alpha-1}{\alpha-\beta}T_{out}-\frac{\beta}{\alpha}\cdot\frac{\alpha-1}{\alpha-\beta}T_{in}$ | 0 | $0.447T_{out}-0.033T_{in}$ | Tin−Tout |
| 4 | HOST BEING FAST LCD BEING SLOW Tout > Tin | UNCOMPRESSED | NO | $\left(1-\frac{T_{in}}{T_{out}}\right)V_{size}$ | NONE | $\left(1-\frac{T_{in}}{T_{out}}\right)V_{size}$ | NONE | NONE |
| 5 | | | YES | 0 | Tout−Tin | 0 | Tout−Tin | NONE |
| 6 | | COMPRESSED | NO | $\left(1-\beta-\beta\frac{\alpha-1}{\alpha-\beta}+\beta\frac{\alpha-1}{\alpha-\beta}\frac{T_{in}}{T_{out}}\right)V_{size}$ | NONE | $\left(0.819+0.056\frac{T_{in}}{T_{out}}\right)V_{size}$ | NONE | NONE |
| 7 | | | YES | 0 | $\left(1-\frac{1}{\alpha}+\frac{1-\beta}{\alpha-\beta}\right)T_{out}-\frac{1-\beta}{\alpha-\beta}T_{in}$ | 0 | $0.967T_{out}-0.553T_{in}$ | NONE |

MEMORY CONTROL DEVICE AND MOBILE TERMINAL

TECHNICAL FIELD

The present invention relates to (i) a memory control device for writing image data, transferred from a host processor, into a frame memory and for reading the image data from the frame memory to transfer the image data to a display panel such as a liquid crystal display (LCD) and (ii) a mobile terminal including that memory control device.

BACKGROUND ART

In a case where image data is transferred from a host processor (hereinafter referred to simply as "host") to a display panel such as an LCD, that image data is typically first stored temporarily in a frame memory (hereinafter referred to simply as "memory") of an LCD controller (LCDC), and is then outputted to the display panel. This arrangement eliminates the need to transfer image data from the host to the display panel while the display data is not updated.

A seamless process such as reproducing a moving image, however, involves substantially simultaneous, parallel steps of (i) inputting image data from the host to the memory of the LCDC (write operation) and (ii) outputting the image data from the LCDC to the display panel (read operation).

Thus, in a case where it is impossible to compensate for the difference between the respective rates of image data transfer, incomplete image data stored in the memory is outputted to the display panel, that is, there occurs overtaking for image data (called "tearing"). Tearing lets incomplete image data be outputted to the display panel, with the result of flicker during image display.

Patent Literature 1 discloses a method for updating a frame buffer (memory) as a conventional technique for preventing such tearing. This method is for transmitting timing information through a communication link between a first processor and a second processor.

The above method is arranged such that the communication link is in a suspend mode, and that the first processor schedules time events to transmit timing information to the second processor. The above method is further arranged such that the first processor starts a link wakeup at the occurrence of a time event, that the second processor detects the link wakeup, and that the first processor and the second processor are synchronized with each other for the transmitted timing information on the basis of timing of the detected link wakeup.

CITATION LIST

Patent Literature 1

Japanese Patent Application Publication, Tokukai, No. 2011-41290 A (Publication Date: Feb. 24, 2011)

SUMMARY OF INVENTION

Technical Problem

The above conventional technique unfortunately has the following problems:

Conventional techniques involve substantially simultaneous, parallel operations of writing and reading image data into and from a memory for a single frame only as described above. This makes it impossible to stop reading image data from a display memory for a display output. The conventional technique disclosed in Patent Literature 1 above thus requires either (i) waiting until a time point at which no tearing is estimated to occur and then starting a write operation or (ii) in a case where a write operation is to start at a time point at which tearing is estimated to occur, suspending the write operation.

The case (i) above is, however, problematic as follows: It is necessary to wait until it is safe each time the host updates image data for display. It is, in the worst case, necessary to wait for a maximum of a time period corresponding to a single frame. This has a negative effect: The memory on the side of the host cannot be freed until the end of data transfer for an image data update. Thus, even in a case where the host has a double-buffer structure, it is necessary to wait before the start of preparing image data for a frame after next, which unfortunately causes frame dropping.

The case (i) above is further problematic as follows: Even in a case where there is no coming update of image data, the operation on the side of the host cannot be stopped until the end of image data transfer. This wastes electric power for a certain time period.

The case (ii) above is also problematic in that suspending a write operation causes frame dropping.

Further, Patent Literature 1 is silent about how to prevent tearing for a case in which image data is compressed and written into a frame memory, and is read and expanded for transfer to a display control section.

The present invention has been accomplished in view of the above problems. It is on object of the present invention to prevent tearing even in a case where image data is compressed for each frame to be written into a frame memory.

Solution to Problem

A memory control device according to a mode of the present invention is a memory control device, including: a frame memory having a predetermined recording capacity; a compression section for (i) compressing image data for a single frame, the image data being transferred from a host, into a size not larger than the recording capacity and (ii) writing the compressed image data into the frame memory; an expansion section for (i) reading the compressed image data from the frame memory, (ii) expanding the compressed image data, and (iii) transferring the expanded image data to a display control section; and a timing control section for, until an inhibit time period Ts passes from a start of reading compressed image data for a first frame, inhibiting a start of writing compressed image data for a second frame subsequent to the first frame, the inhibit time period Ts being so preset as to prevent coincidence between a range of a move of a read position over the frame memory and a range of a move of a write position over the frame memory.

A memory control device according to another mode of the present invention is a memory control device, including: a frame memory having a predetermined recording capacity; a compression section for (i) compressing image data for a single frame, the image data being transferred from a host, into a size not larger than an upper limit value Vsize and (ii) writing the compressed image data into the frame memory; and an expansion section for (i) reading the compressed image data from the frame memory, (ii) expanding the compressed image data, and (iii) transferring the expanded image data to a display control section, the predetermined recording capacity of the frame memory being so set as to prevent coincidence between a range of a move of a read position over the frame memory and a range of a move of a write position over the frame memory.

Advantageous Effects of Invention

A mode of the present invention makes it possible to prevent tearing even in such a case where image data is compressed to be recorded in a frame memory.

Additional objects, features, and strengths of the present invention will be made clear by the description below. Further, the advantages of the present invention will be evident from the following explanation in reference to the drawings.

BRIEF DESCRIPTION OF DRAWINGS

FIG. 9 is a table that summarizes the relationships between (i) a critical time period Td and additional capacity Va in the modes above and (ii) Tin and Tout.

DESCRIPTION OF EMBODIMENTS

Figure 1:
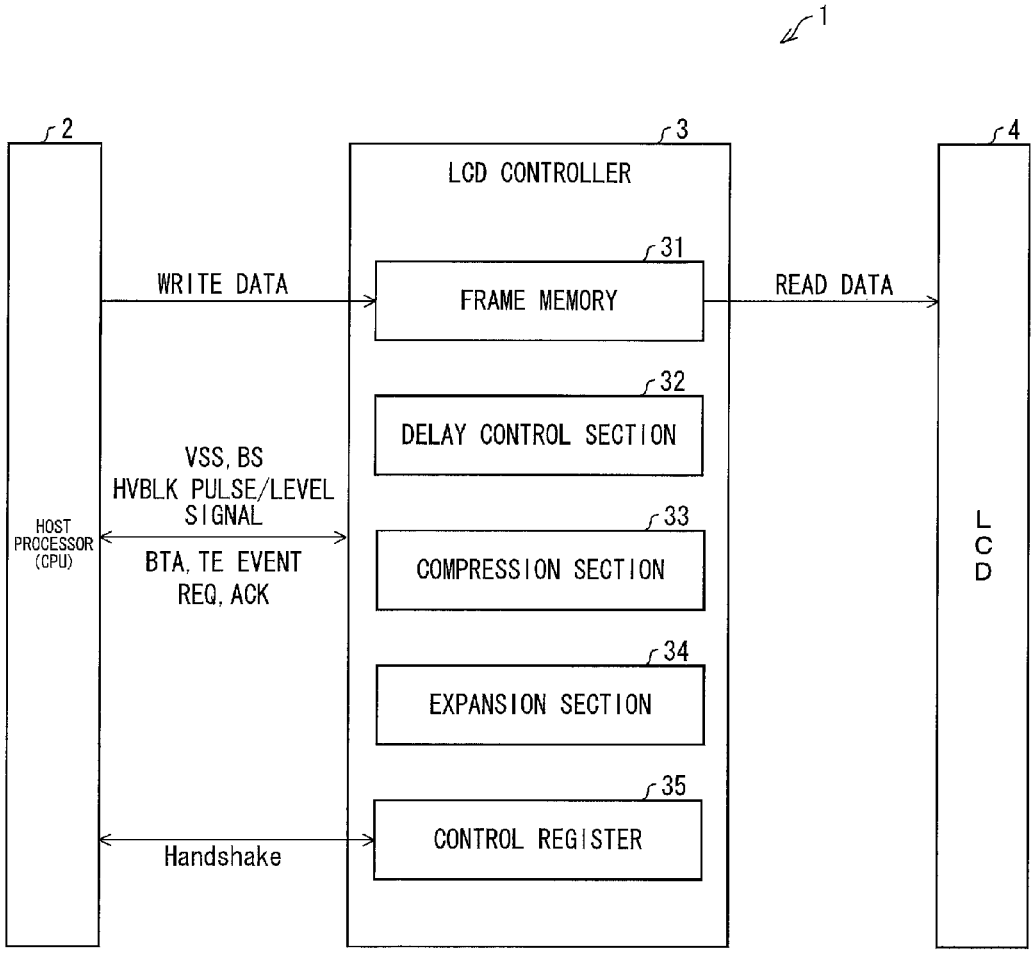
FIG. 1 is a block diagram illustrating a configuration of an image transfer system according to a mode of the present invention.
Figure 2:
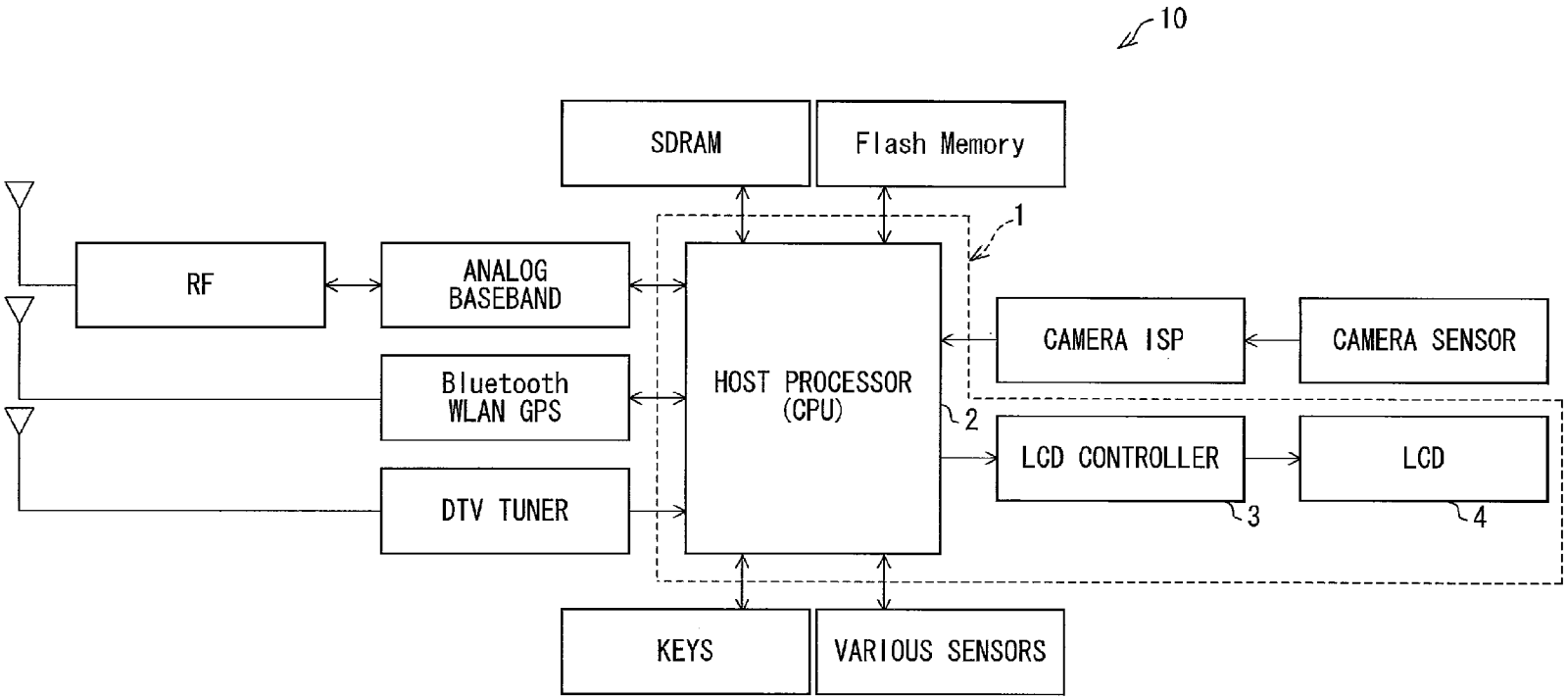
FIG. 2 is a block diagram illustrating a configuration of a mobile terminal according to a mode of the present invention.

The description below deals with embodiments of the present invention with reference to FIGS. 1 through 14. Any member not described in a section is, if described in another section, identical to such a member described in the other section. For convenience of description, any member described in a section which member is identical in function to a corresponding member described in another section is assigned an identical reference numeral, and a description of such a member is omitted as appropriate.

Embodiment 1

Image Transfer System 1

The description below deals with an image transfer system 1 as an embodiment of the present invention with reference to FIG. 1. FIG. 1 is a block diagram illustrating a configuration of the image transfer system 1.

The image transfer system 1, as illustrated in FIG. 1, includes a host processor 2 (host), an LCD controller 3, and an LCD 4 (display control section). The image transfer system 1 of the present embodiment is a device that carries out (i) a write operation of writing image data (data), transferred from the host processor 2, into a frame memory 31 described below and (ii) a read operation of reading image data from the frame memory 31 to transfer the image data to the LCD 4. The LCD controller 3 is an embodiment of the memory control device of the present invention.

(Host Processor 2)

The host processor 2 is a central processing unit (CPU) of the device (for example, a mobile terminal 10 in FIG. 2), and controls the overall operation of the device. The host processor 2 also supplies (transfers), to the LCD controller 3, data such as (i) image data to be transferred to the LCD 4, (ii) various signals such as a REQ (request) signal, (iii) various control commands such as a command to control a handshake flag and a command to control a bus turnaround (BTA), and (iii) various packets such as a VSS (vertical sync start) packet and a BS (blanking start) packet. The host processor 2 transfers, to the LCD controller 3, uncompressed image data representative of an image for a single frame.

(LCD Controller 3)

The LCD controller 3 has a mechanism for inputting and outputting image data, and carries out various processes such as (i) a write operation of writing image data, transferred from the host processor 2, into the frame memory 31 and (ii) a read operation of reading image data from the frame memory 31 to transfer the image data to the LCD 4.

The LCD controller 3 (i) receives from the host processor 2 image data for a single frame (hereinafter referred to as "single-frame image data"), (ii) compresses the image data through a predetermined compression method, and (iii) writes the compressed image data into the frame memory 31. The LCD controller 3 also (i) reads compressed single-frame image data from the frame memory 31, (ii) expands the image data, and (iii) transfers the expanded image data to the LCD 4.

The LCD controller 3 (memory control device), as illustrated in FIG. 1, includes a frame memory 31, a delay control section (timing control section) 32, a compression section 33, an expansion section 34, and a control register 35.

(Frame Memory 31)

The frame memory 31 is an image memory capable of storing single-frame image data compressed through a predetermined compression method. The frame memory 31 thus has a capacity (recording capacity) smaller in size than uncompressed single-frame image data transferred from the host processor 2. The frame memory 31 has a capacity represented by Vsize (upper limit value).

(Delay Control Section 32)

The delay control section 32 controls timing of the start of image data writing by the compression section 33 so that until a preset inhibit time period Ts passes after the expansion section 34 starts reading image data for a frame from the frame memory 31, the compression section 33 is inhibited from writing image data for a subsequent frame into the frame memory 31. The delay control section 32, after the inhibit time period Ts passes after the expansion section 34 starts reading image data for a frame, permits the compression section 33 to start writing image data for a subsequent frame. The inhibit time period Ts may be (i) not shorter than a critical time period Td described below and (ii) shorter than a read time period Tout. The critical time period Td may be determined on a worst-case assumption. The read time period Tout refers to a (fixed) time period extending from the start of a read operation to its end. A write time period Tin refers to a (fixed) time period extending from the start of a write operation to its end.

The delay control section 32, in a case where Tin>Tout, controls timing of the start of image data reading by the expansion section 34 so that until a preset output delay time period Outdly passes after the compression section 33 starts writing image data for a frame into the frame memory 31, the expansion section 34 is inhibited from reading image data for that frame from the frame memory 31.

(Compression Section 33)

The compression section 33 compresses single-frame image data received from the host processor 2 through a predetermined compression method, and writes the compressed single-frame image data into the frame memory 31. The compression method used by the compression section 33 serves to compress image data in such a manner that the image data is variable in length for each frame. Thus, the compressed image data may vary in size for each frame. Image data is written into the frame memory 31 at a variable rate, and read from the frame memory 31 at a variable rate. The write rate and read rate have an upper limit value and lower limit value, respectively. Further, the compression method used by the compression section 33 has a fixed compression ratio (for example, a compression ratio of 1/2). This ensures that any compressed single-frame image data has a size not larger than the upper limit value of Vsize. In a case where the compression ratio is 1/2, uncompressed image data (for a single frame) transferred from the host processor 2 has a size of Vsize×2.

(Expansion Section 34)

The expansion section 34 reads compressed single-frame image data from the frame memory 31, and expands the image data through a method corresponding to the compression method. The expansion section 34 transfers the expanded single-frame image data to the LCD 4.

(Control Register 35)

The control register 35, for example, stores various control commands supplied from the host processor 2, and transmits such stored control commands to the host processor 2. Examples of the control commands include commands to specify various pieces of data for use in, for example, setting such parameters for individual sections (circuits) as an image size, a line size, a frequency, and a transfer waiting time.

(LCD 4)

The LCD 4 displays image data transferred from the host processor 2 via the LCD controller 3.

The LCD 4 of the present embodiment is, for example, a liquid crystal display panel (oxide semiconductor liquid crystal panel) including thin film transistors (TFTs) each having a semiconductor layer made of an oxide semiconductor. The oxide semiconductor is, for example, an oxide of indium, gallium, and zinc (In—Ga—Zn—O).

[Characteristic Operation of Image Transfer System 1]

The image transfer system 1 is arranged such that the LCD controller 3 compresses image data received from the host processor 2 and writes the compressed image data into the frame memory 31. This arrangement allows the frame memory 31 to have a small capacity.

The present embodiment is restricted as follows: The compression section 33 uses a compression method with which compressed image data has a size not larger than the upper limit value of Vsize. Further, the LCD controller 3 receives single-frame image data from the host processor 2 over a fixed time period, whereas the LCD controller 3 transfers single-frame image data to the LCD 4 over a fixed time period as well. In other words, the LCD controller 3 writes single-frame image data into the frame memory 31 over a fixed time period (write time period Tin), whereas the LCD controller 3 reads single-frame image data from the frame memory 31 over a fixed time period (read time period Tout). However, the LCD controller 3 writes and reads single-frame image data into and from the frame memory 31 at respective rates each of which varies according to the content of the image even for a given image size. A higher compression ratio requires the LCD controller 3 to have a higher write rate and a higher read rate. Further, a change in the compression ratio during a write or read operation changes the write or read rate accordingly. In a case where compressed image data has a size of Vsize, the average write rate wp during the write time period Tin is Vsize/Tin. The LCD controller 3 writes single-frame image data into the frame memory 31 at a rate that is variable between a maximum write rate $\alpha$wp and a minimum write rate $\beta$wp, where $\alpha$ and $\beta$ are each a coefficient determined in advance according to the compression method. Further, in the case where compressed image data has a size of Vsize, the average read rate rp during the read time period Tout is Vsize/Tout. The LCD controller 3 reads single-frame image data from the frame memory 31 at a rate that is variable between a maximum read rate $\alpha$rp and a minimum read rate $\beta$rp. The coefficient $\alpha$ for the maximum rate and the coefficient $\beta$ for the minimum rate are each identical between a write operation and a read operation. In a case where the LCD controller 3 writes image data for a frame at a low rate, the LCD controller 3 reads that image data at a low rate as well. In a case where the LCD controller 3 writes image data for a frame at a high rate, the LCD controller 3 reads that image data at a high rate as well. Since image content differs between different frames, there should be no correlation between the write rate and the read rate across different frames.

The LCD controller 3 controls the timing of the start of a write operation to prevent tearing even in a case where the write rate and read rate change within the above limits. The write time period Tin and read time period Tout each depend on the specifications of the image transfer system 1. The description below deals with the operation of the LCD controller 3 for different cases in correspondence with the relationship in length between Tin and Tout.

(Case of Write Time Period Tin>Read Time Period Tout)

Figure 3:
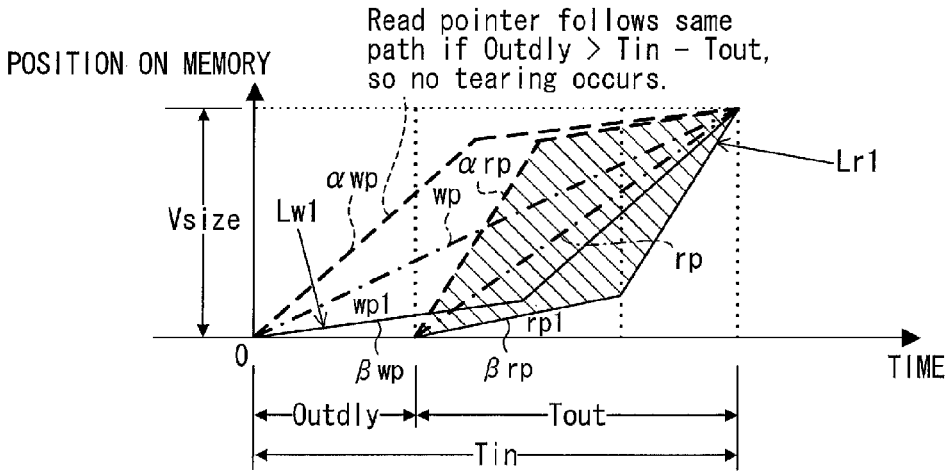
FIG. 3 is a graph illustrating how, in accordance with a mode of the present invention, image data is written into and read from a frame memory in a case where a write time period Tin is longer than a read time period Tout.

FIG. 3 is a graph illustrating how image data is written into and read from the frame memory 31 in a case where the write time period Tin is longer than the read time period Tout. This case corresponds to a case in which the LCD controller 3 receives image data from the host processor 2 more slowly than the LCD controller 3 transfers image data to the LCD 4. FIG. 3 shows (i) a horizontal axis indicative of time and (ii) a vertical axis indicative of positions (addresses) on the frame memory 31. The frame memory 31 has a capacity equal to the maximum size Vsize of compressed image data.

First, the LCD controller 3 starts writing image data for a first frame at the origin at the lower left corner in FIG. 3. The compressed image data has a size of Vsize. The compression section 33 writes (compressed) image data into the frame memory 31 over the write time period Tin. The average write rate wp during the write time period Tin is Vsize/Tin, and corresponds to the inclination of the dotted-and-dashed line in FIG. 3. The maximum write rate αwp during the write time period Tin corresponds to the inclination of the broken line in FIG. 3. The minimum write rate βwp during the write time period Tin corresponds to the inclination of the solid line in FIG. 3. These lines each indicate where on the frame memory 31 a write pointer (which indicates the position at which image data is being written) is present at any given time point.

Specifically, in a case where the LCD controller 3 writes image data at the minimum write rate βwp, the write pointer follows the path Lw1. The write rate, however, rises at a time point on the path Lw1 to meet the requirement of single-frame image data being written over the fixed write time period Tin. The path Lw1 shows how the write pointer moves in a case where the LCD controller 3 writes image data at the minimum write rate βwp until a certain time point and then at the maximum write rate αwp from the time point on. The path Lw1 indicates a case in which the write pointer moves over the frame memory 31 most slowly from the start of a write operation, that is, the LCD controller 3 writes image data most slowly.

In a case where the LCD controller 3 writes image data at the maximum write rate αwp from the start of the write operation, the LCD controller 3, at a time point, similarly starts writing the image data at the minimum write rate βwp to meet the requirement of single-frame image data being written over the fixed write time period Tin.

In FIG. 3, the write path indicated by a broken line and the write path (Lw1) indicated by a solid line define a parallelogrammatic region indicative of a range in which the write pointer may move in actuality. This means that the write pointer does not move at a fixed rate but may follow any path within the parallelogrammatic region depending on the image content.

The expansion section 34 is permitted, an output delay time period Outdly after the start of writing image data for a first frame, to start reading the image data for the first frame. The beginning of the image data written for the first frame corresponds to the position on the frame memory 31 at which position the write operation started, so the expansion section 34 starts reading the image data for the first frame at the same position. The expansion section 34 reads single-frame image data over a fixed read time period Tout. This means that a read pointer (which indicates the position at which image data is being read) may similarly move within the parallelogrammatic region (indicated by a hatched portion in FIG. 3) defined by the respective lines indicative of the maximum read rate αrp and the minimum read rate βrp.

In a case where image data is written at a low rate, that image data is read at a low rate as well, whereas in a case where image data is written at a high rate, that image data is read at a high rate as well. In other words, for any given image data for a frame, the write pointer wp1 and the read pointer rp1 follow respective paths similar to each other. Specifically, for any given image data, (i) in a case where the write pointer followed a path on which the write pointer begins writing image data at the maximum write rate αwp, the read pointer follows a path on which the read pointer begins reading image data at the maximum read rate αrp, and (ii) in a case where the write pointer followed a path on which the write pointer begins writing image data at the minimum write rate βwp, the read pointer follows a path on which the read pointer begins reading image data at the minimum read rate βrp.

A write operation and read operation for the same image data may be performed concurrently as illustrated in FIG. 3. In a case where the output delay time period Outdly is equal to |write time period Tin−read time period Tout|, the write pointer wp1 lies, at the time point of the end of the write operation, at the same position as the read pointer rp1 at the time point of the end of the read operation. This indicates that as long as the output delay time period Outdly is larger than |Tin−Tout|, a read operation will not overtake a write operation, in other words, a read operation on image data is performed after a write operation on the same image data without causing tearing.

With the output delay time period Outdly set as described above, in a case where image data for a first frame is written at a rate along the path Lw1, that image data is read at a rate along the path Lr1. Thus, even a low write rate will cause no tearing. The expansion section 34 may start a read operation later than the end of the output delay time period Outdly. In this case, the expansion section 34 ends a read operation at a time point that is later in accordance with the time period by which the start of the read operation was delayed with respect to the time point of the end of the write operation.

Figure 4:
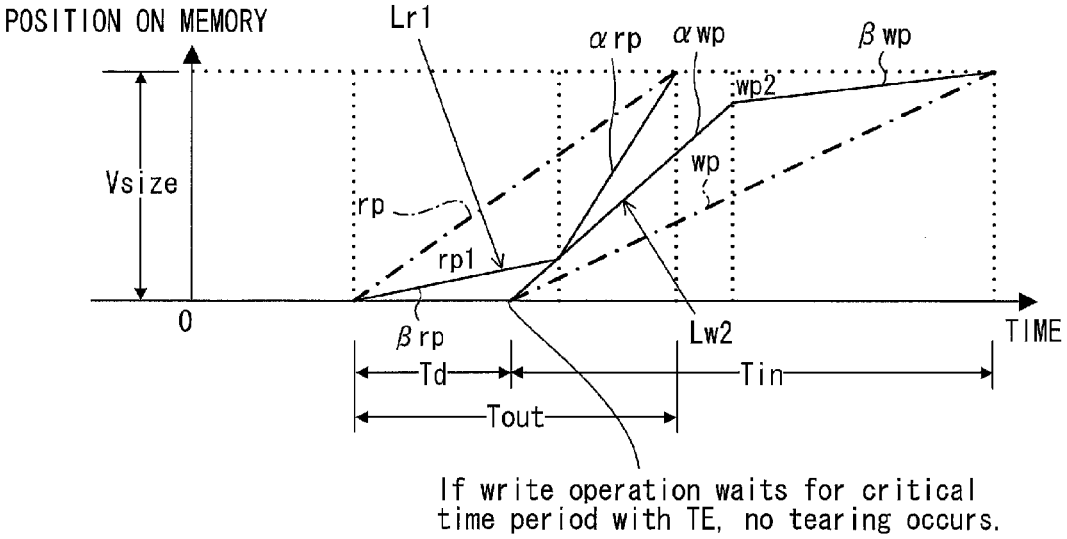
FIG. 4 is a graph illustrating how, in accordance with a mode of the present invention, image data is written into and read from a frame memory in a case where a write time period Tin is longer than a read time period Tout.

FIG. 4 is a graph illustrating how image data is written into and read from the frame memory 31 in a case where the write time period Tin is longer than the read time period Tout. FIG. 4 illustrates a case in which (i) the expansion section 34 starts reading image data for a first frame, and then (ii) the compression section 33 writes image data for a subsequent second frame. This case assumes that the compression section 33 already ended writing the image data for the first frame before the expansion section 34 starts reading the image data for the first frame.

The expansion section 34 reads image data for a first frame most slowly in a case where the read pointer rp1 follows the path Lr1, on which the expansion section 34 begins reading image data at the minimum read rate βrp. The compression section 33 writes image data for a second frame most rapidly in a case where the write pointer wp2 follows the path Lw2, on which the compression section 33 begins writing image data at the maximum write rate αwp. As illustrated in FIG. 4, in a case where the compression section 33 starts a write operation on the image data for the second frame a predetermined critical time period Td after the expansion section 34 starts reading the image data for the first frame, the path Lr1 of the read pointer for the first frame is in contact with the path Lw2 of the write pointer for the second frame, that is, the read pointer and the write pointer become coincident at a position at a time point. In a case where the compression section 33 starts a write operation on the image data for the second frame the predetermined critical time period Td after the expansion section 34 starts reading the image data for the first frame, the write pointer wp2 for the second frame will not overtake the read pointer rp1 for the first frame, in other words, no tearing occurs.

In a case where the write time period Tin>the read time period Tout, the critical time period Td in the formula below (Formula 1) may be calculated geometrically with reference to FIG. 4.

$$Td = \frac{\alpha - 1}{\alpha - \beta} T_{out} - \frac{\beta}{\alpha} \cdot \frac{\alpha - 1}{\alpha - \beta} T_{in} \quad \text{[Math. 1]}$$

In a case where, for instance, the compression method is such that α=41/24 and β=3/24, Td=0.447×Tout−0.033×Tin.

The inhibit time period Ts, during which a write operation is inhibited, may thus be (i) not shorter than the critical time period Td and (ii) shorter than the read time period Tout. The inhibit time period Ts being not shorter than the critical time period Td prevents tearing. The inhibit time period Ts being shorter than the read time period Tout permits the compression section 33 to start a write operation early. In a case where the inhibit time period Ts=the critical time period Td, both (i) tearing is prevent, and (ii) the host processor 2 is permitted earliest to transfer data. As described above, the present embodiment, on the basis of the range within which the read pointer rp1 may move and the range within which the write pointer wp2 may move, presets the inhibit time period Ts so that the read pointer rp1 moving over the frame memory 31 most slowly for a first frame will not be overtaken by the write pointer wp2 moving over the frame memory 31 most rapidly for a second frame. The present embodiment, in other words, presets the inhibit time period Ts so that the write pointer wp2 and the read pointer rp1 do not become coincident.

In the case where compressed image data has a size of the upper limit of Vsize, the read pointer for a first frame may be approached most closely by the write pointer for a second frame. Even in a case where compressed image data has a size of less than Vsize, no tearing occurs as long as the compression section 33 is inhibited from starting a write operation until the critical time period Td passes after the expansion section 34 starts reading the image data for the first frame.

The inhibit time period Ts may alternatively have a margin. For instance, the inhibit time period Ts may be set to be (i) not shorter than the critical time period Td and (ii) not longer than Td×11/10 so that the inhibit time period Ts has a margin of approximately 10% of the critical time period Td.

(Case of Write Time Period Tin<Read Time Period Tout)

Figure 5:
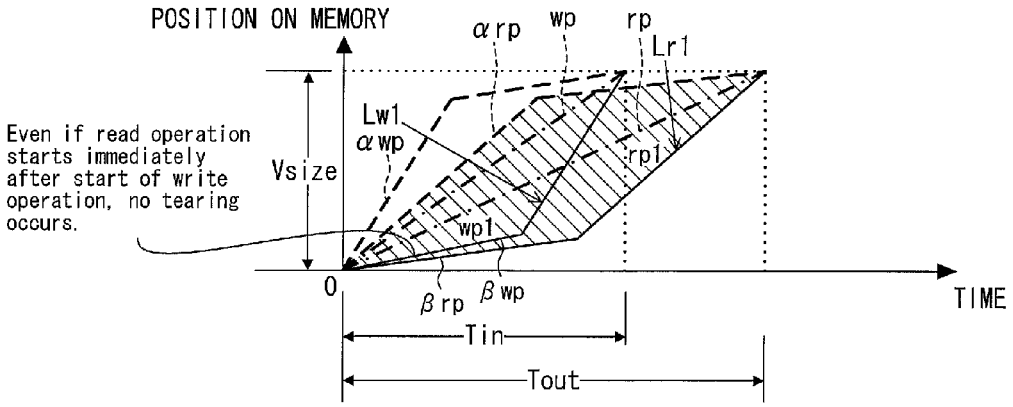
FIG. 5 is a graph illustrating how, in accordance with a mode of the present invention, image data is written into and read from a frame memory in a case where a write time period Tin is shorter than a read time period Tout.

FIG. 5 is a graph illustrating how image data is written into and read from the frame memory 31 in a case where the write time period Tin is shorter than the read time period Tout. This case corresponds to a case in which the LCD controller 3 receives image data from the host processor 2 faster than the LCD controller 3 transfers image data to the LCD 4. FIG. 5 shows (i) a horizontal axis indicative of time and (ii) a vertical axis indicative of positions (addresses) on the frame memory 31. The frame memory 31 has a capacity of Vsize.

First, the LCD controller 3 starts writing image data for a first frame at the origin at the lower left corner in FIG. 5. The compressed image data has a size of Vsize. The compression section 33 writes (compressed) image data into the frame memory 31 over the write time period Tin. The signs in FIG. 5 are identical in meaning to those in FIGS. 3 and 4. Note, however, that the relationship in length between Tin and Tout is inverted from that in FIGS. 3 and 4.

The expansion section 34 is permitted, immediately after the start of writing image data for a first frame, to start reading the image data for the first frame. The beginning of the image data written for the first frame corresponds to the position on the frame memory 31 at which position the write operation started, so the expansion section 34 starts reading the image data for the first frame at the same position.

In a case where image data is written at a low rate, that image data is read at a low rate as well, whereas in a case where image data is written at a high rate, that image data is read at a high rate as well. In other words, for any given image data for a frame, the write pointer wp1 and the read pointer rp1 follow respective paths similar to each other. Specifically, for any given image data, (i) in a case where the write pointer followed a path on which the write pointer begins writing image data at the maximum write rate αwp, the read pointer follows a path on which the read pointer begins reading image data at the maximum read rate αrp, and (ii) in a case where the write pointer followed a path on which the write pointer begins writing image data at the minimum write rate βwp, the read pointer follows a path on which the read pointer begins reading image data at the minimum read rate βrp.

Thus, as illustrated in FIG. 5, even in a case where the expansion section 34 starts reading image data immediately after the compression section 33 starts writing the image data, a read operation will not overtake a write operation because even in a case where the compression section 33 writes image data most slowly (path Lw1), the expansion section 34 reads the image data slowly as well (path Lr1). In a case where Tin<Tout, the present embodiment needs no output delay time period Outdly.

Figure 6:
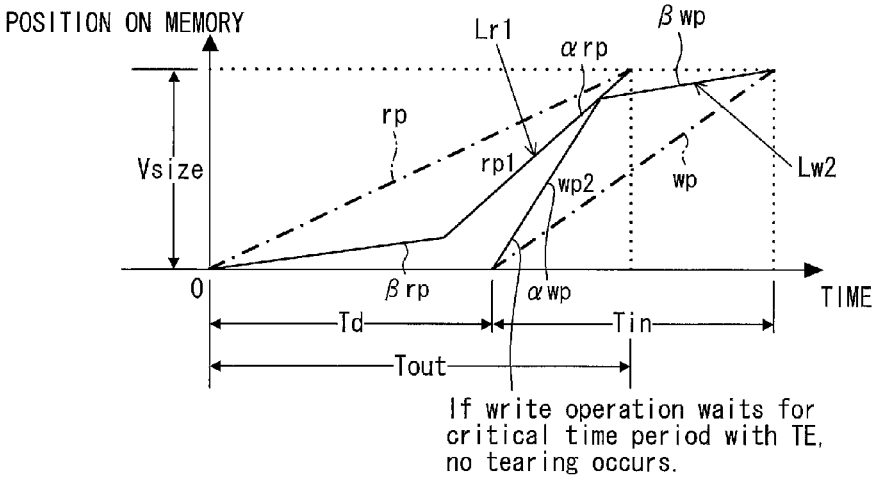
FIG. 6 is a graph illustrating how, in accordance with a mode of the present invention, image data is written into and read from a frame memory in a case where a write time period Tin is shorter than a read time period Tout.

FIG. 6 is a graph illustrating how image data is written into and read from the frame memory 31 in a case where the write time period Tin is shorter than the read time period Tout. FIG. 6 illustrates a case in which (i) the expansion section 34 starts reading image data for a first frame, and then (ii) the compression section 33 writes image data for a subsequent second frame. This case assumes that the compression section 33 already ended writing the image data for the first frame before the expansion section 34 starts reading the image data for the first frame.

The expansion section 34 reads image data for a first frame most slowly in a case where the read pointer rp1 follows the path Lr1, on which the expansion section 34 begins reading image data at the minimum read rate βrp. The compression section 33 writes image data for a second frame most rapidly in a case where the write pointer wp2 follows the path Lw2, on which the compression section 33 begins writing image data at the maximum write rate αwp. As illustrated in FIG. 6, in a case where the compression section 33 starts a write operation on the image data for the second frame a predetermined critical time period Td after the expansion section 34 starts reading the image data for the first frame, the path Lr1 of the read pointer for the first frame is in contact with the path Lw2 of the write pointer for the second frame, that is, the read pointer and the write pointer become coincident at a position at a time point. In a case where the compression section 33 starts a write operation on the image data for the second frame the predetermined critical time period Td after the expansion section 34 starts reading the image data for the first frame, the write pointer wp2 for the second frame will not overtake the read pointer rp1 for the first frame, in other words, no tearing occurs.

In a case where the write time period Tin<the read time period Tout, the critical time period Td in the formula below (Formula 2) may be calculated geometrically with reference to FIG. 6.

$$Td = \left(1 - \frac{1}{\alpha} + \frac{1-\beta}{\alpha-\beta}\right)T_{out} - \frac{1-\beta}{\alpha-\beta}T_{in} \quad \text{[Math. 2]}$$

In a case where, for instance, the compression method is such that α=41/24 and ρ=3/24, Td=0.967×Tout−0.553×Tin.

The inhibit time period Ts, during which a write operation is inhibited, may be (i) not shorter than Td and (ii) shorter than the read time period Tout. In a case where the inhibit time period Ts=the critical time period Td, both (i) tearing is prevent, and (ii) the host processor 2 is permitted earliest to transfer data.

In the case where compressed image data has a size of the upper limit of Vsize, the read pointer for a first frame may be approached most closely by the write pointer for a second frame. Even in a case where compressed image data has a size of less than Vsize, no tearing occurs as long as the compression section 33 is inhibited from starting a write operation until the critical time period Td passes after the expansion section 34 starts reading the image data for the first frame.

The critical time period Td in each of Formulae 1 and 2 above assumes that the compression section 33, when writing single-frame image data into the frame memory 31, starts the write operation at a position on the frame memory 31 which position follows the position at which the compression section 33 ended writing image data for the immediately previous frame.

Under the condition that the compression section 33 starts a write operation constantly at the same position on the frame memory 31 (for example, the first position), the critical time period Td is longer than indicated in Formulae 1 and 2 above. In this case, the critical time period Td=Tout−(β/α) Tin regardless of whether Tin>Tout or Tin<Tout. Under the above condition, the worst case is a case in which (i) compressed image data for a first frame has a size of βrp×Tout, and (ii) the compression section 33 starts writing image data for a second frame at the maximum write rate αwp.

(Flow of Timing Control)

Figure 10:
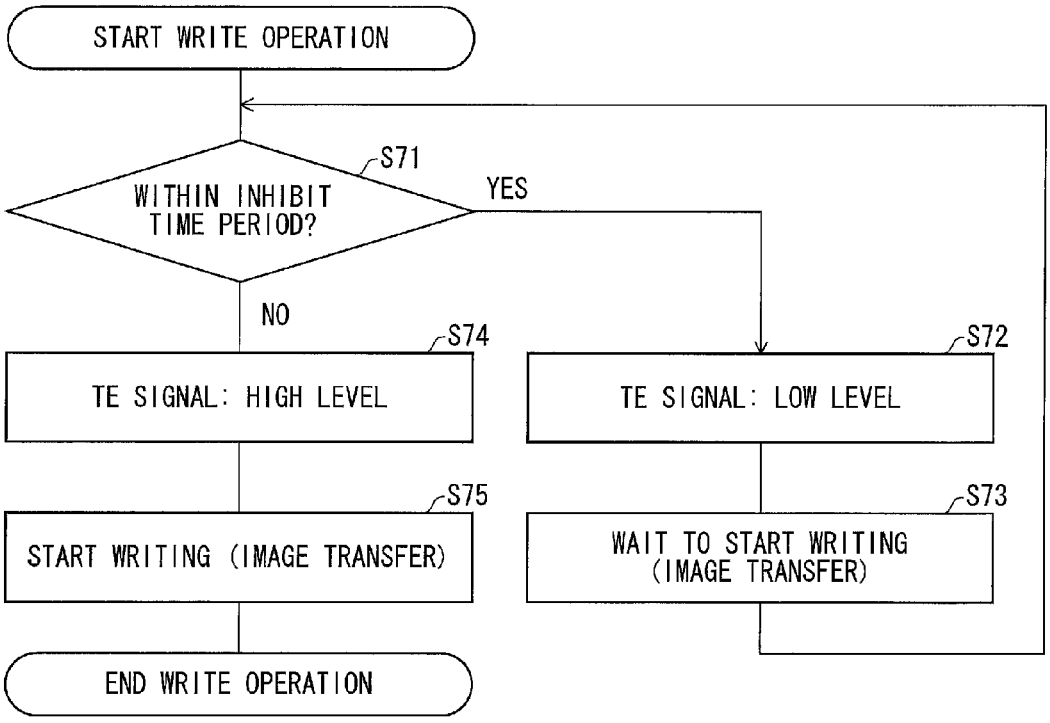
FIG. 10 is a flowchart illustrating example timing control carried out by an LCD controller for an operation of the image transfer system.

With reference to FIG. 10, the description below deals with an example flow of timing control carried out by the LCD controller 3. FIG. 10 is a flowchart illustrating example timing control carried out by the LCD controller 3 for an operation of the image transfer system 1.

First, the delay control section 32 determines whether the compression section 33 will, upon receipt of image data, start a write operation at a time point within the inhibit time period Ts (step S71).

In a case where the compression section 33 will start a write operation at a time point within the inhibit time period Ts (Yes in S71), the LCD controller 3 transmits to the host processor 2 a low-level TE (tearing effect) signal indicative of the inhibit time period Ts (S72).

The host processor 2, upon receipt of a low-level TE signal, waits to transfer image data (S73). The LCD controller 3 also waits to write image data. The process then repeats the steps S71 through S73.

In a case where the compression section 33 will start a write operation at a time point outside the inhibit time period Ts (No in S71), the LCD controller 3 transmits to the host processor 2 a high-level TE signal indicative of a period other than the inhibit time period Ts (S74).

The host processor 2, upon receipt of a high-level TE signal, starts transfer of image data during a time period in which the TE signal has a high level (S75). The LCD controller 3, upon receipt of image data, compresses the image data and starts writing the compressed image data into the frame memory 31.

(Notification of Inhibit Time Period with TE Signal)

Figure 11:
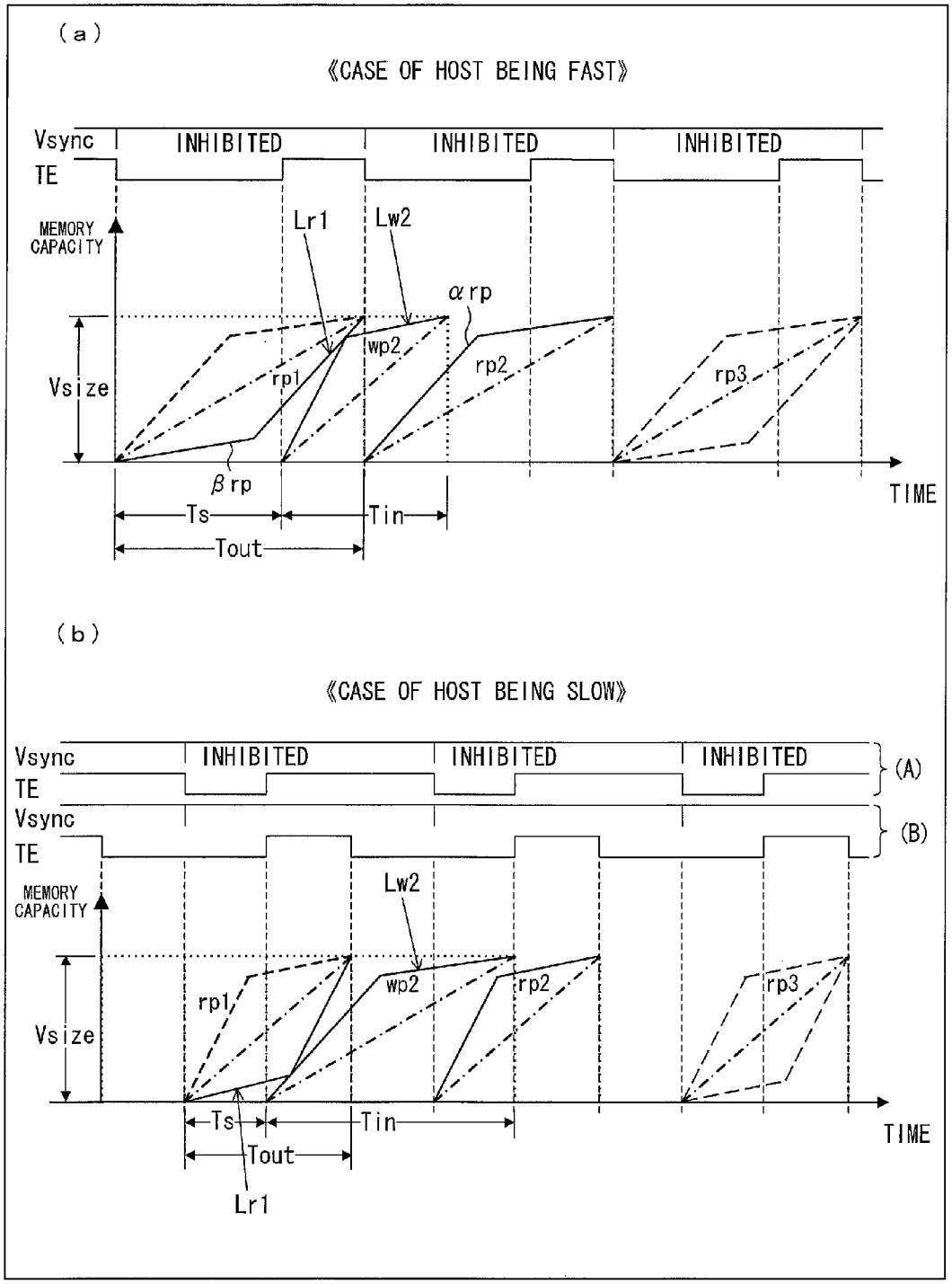
FIG. 11 shows graphs each illustrating timing for a TE signal for notifying a host of an inhibit time period, where (a) shows timing for a TE signal for a case in which a write time period Tin is shorter than a read time period Tout, and (b) shows timing for a TE signal for a case in which a write time period Tin is longer than a read time period Tout.

FIG. 11 shows graphs each illustrating timing for a TE signal for notifying the host of the inhibit time period Ts. The TE signal is a binary signal having either of a low level and a high level. The TE signal is transmitted by the LCD controller 3 to the host processor 2. A low-level TE signal indicates the inhibit time period Ts, whereas a high-level TE signal indicates a period other than the inhibit time period. The graphs in FIG. 11 each show a vertical synchronizing signal Vsync, which is a signal transmitted by the LCD 4 to the LCD controller 3. The LCD controller 3 starts reading image data at timing at which the vertical synchronizing signal Vsync falls to a low level (low pulse).

The host processor 2 does not start transfer of image data while the TE signal has a low level, and starts transfer of image data to the LCD controller 3 while the TE signal has a high level.

(Case of Tin<Tout)

(a) of FIG. 11 shows a TE signal for a case in which Tin<Tout. (a) of FIG. 11 omits indicating a write operation on image data for a first frame and a write operation on image data for a third frame. The TE signal falls to a low level at the time point of the start of reading image data for the first frame. The TE signal rises to a high level when the inhibit time period Ts has passed after the TE signal fell to the low level.

While the TE signal has a high level, (i) the host processor 2 transfers image data for the second frame, and (ii) the compression section 33 of the LCD controller 3 compresses the image data received and starts writing the compressed image data into the frame memory 31. The TE signal then falls to a low level at the time point at which the expansion section 34 starts a read operation on image data for the second frame on the basis of the vertical synchronizing signal Vsync.

(Case of Tin>Tout)

(b) of FIG. 11 shows a TE signal for a case in which Tin>Tout. (b) of FIG. 11 omits indicating a write operation on image data for a first frame and a write operation on image data for a third frame. (A) shows an example signal for a case in which the LCD 4 is an oxide semiconductor liquid crystal panel. (B) shows an example signal for a case in which the LCD 4 is a continuous grain silicon (CGS) liquid crystal panel.

In the case where the LCD 4 is an oxide semiconductor liquid crystal panel (A), the TE signal falls to a low level at the time point at which the expansion section 34 starts reading image data for the first frame, and rises to a high level when the inhibit time period Ts has passed after the TE signal fell to the low level.

In the case where the LCD 4 is a CGS liquid crystal panel (B), the TE signal falls to a low level at the time point at which the expansion section 34 ends reading image data for the first frame, and rises to a high level when the inhibit time period Ts has passed after the expansion section 34 started reading image data for the second frame.

The host processor 2 is permitted to start transfer of image data while the TE signal has a high level. An oxide semiconductor liquid crystal panel, which may have a refresh rate decreased (changed) to, for example, approximately 60 Hz to 1 Hz, allows the start of image data reading to be delayed (waited for). The oxide semiconductor liquid crystal panel (A) thus allows transfer of image data to start at a time point within a long time period as compared to the CGS liquid crystal panel (B). This allows the host processor 2 to have a higher degree of freedom for timing of the start of image data transfer, and can thus reduce the delay in the process of the host processor 2. This in turn prevents the host processor 2 from becoming unable to process image data, and thus prevents frame dropping in a display image.

Embodiment 2

The description below deals with another embodiment of the present invention. The present embodiment is identical to Embodiment 1 in terms of the configuration of the image transfer system, but is different from Embodiment 1 in the capacity of the frame memory 31 and the operation of the delay control section 32.

(Frame Memory 31)

The frame memory 31 has a capacity Vm larger than Vsize+Va. Va represents an additional capacity, which has a lower limit value that may be determined through a method described below. The capacity Vm of the frame memory 31 is smaller than twice Vsize.

(Delay Control Section 32)

The delay control section 32, in a case where Tin>Tout, controls timing of the start of image data reading by the expansion section 34 so that until a preset output delay time period Outdly passes after the compression section 33 starts writing image data for a frame into the frame memory 31, the expansion section 34 is inhibited from reading image data for that frame from the frame memory 31.

[Characteristic Operation of Image Transfer System]

The present embodiment is restricted similarly to Embodiment 1: The compression section 33 uses a compression method with which compressed image data has a size not larger than the upper limit value of Vsize. The write time period Tin and the read time period Tout are each fixed. A higher compression ratio requires the LCD controller 3 to have a higher write rate and a higher read rate. Further, a change in the compression ratio during a write or read operation changes the write or read rate accordingly. The LCD controller 3 writes single-frame image data into the frame memory 31 at a rate that is variable between a maximum write rate αwp and a minimum write rate βwp. The LCD controller 3 reads single-frame image data from the frame memory 31 at a rate that is variable between a maximum read rate αrp and a minimum read rate βrp. The coefficient α for the maximum rate and the coefficient β for the minimum rate are each identical between a write operation and a read operation. In a case where the LCD controller 3 writes image data for a frame at a low rate, the LCD controller 3 reads that image data at a low rate as well. In a case where the LCD controller 3 writes image data for a frame at a high rate, the LCD controller 3 reads that image data at a high rate as well. The compression section 33, when writing single-frame image data into the frame memory 31, starts the write operation at a position (address) on the frame memory 31 which position follows (which position is near) the position at which the compression section 33 ended writing image data for the immediately previous frame. Image data is written into the frame memory 31 in the order of the address from a write start position, and is read from the frame memory 31 in the order of the address from a read start position. The expansion section 34 starts a read operation on single-frame image data at a position at which the compression section 33 started the immediately previous write operation (that is, for the same frame). The LCD controller 3, after using the last position on the frame memory 31, returns to the first position on the frame memory 31 for a write or read operation. The frame memory 31 is used in a periodic boundary manner in a first-in first-out (FIFO) order. The use in a periodic boundary manner refers to the following manner: When image data has been written up to the last position (address) on the frame memory 31, subsequent image data is written from the first position (address) on the frame memory 31.

The LCD controller 3, immediately after the expansion section 34 started a read operation for a frame, permits the compression section 33 to start a write operation for a subsequent frame. To prevent tearing in such a case, the frame memory 31 has at least an additional capacity Va in addition to a capacity of the upper limit size Vsize of compressed single-frame image data. The capacity Vm of the frame memory 31 is smaller than twice the upper limit size Vsize of compressed single-frame image data.

The write time period Tin and read time period Tout each depend on the specifications of the image transfer system 1. The description below deals with an additional capacity necessary for the frame memory 31 for different cases in correspondence with the relationship in length between Tin and Tout. The necessary additional capacity depends on the relationship in length between Tin and Tout.

(Case of Write Time Period Tin>Read Time Period Tout)

Figure 7:
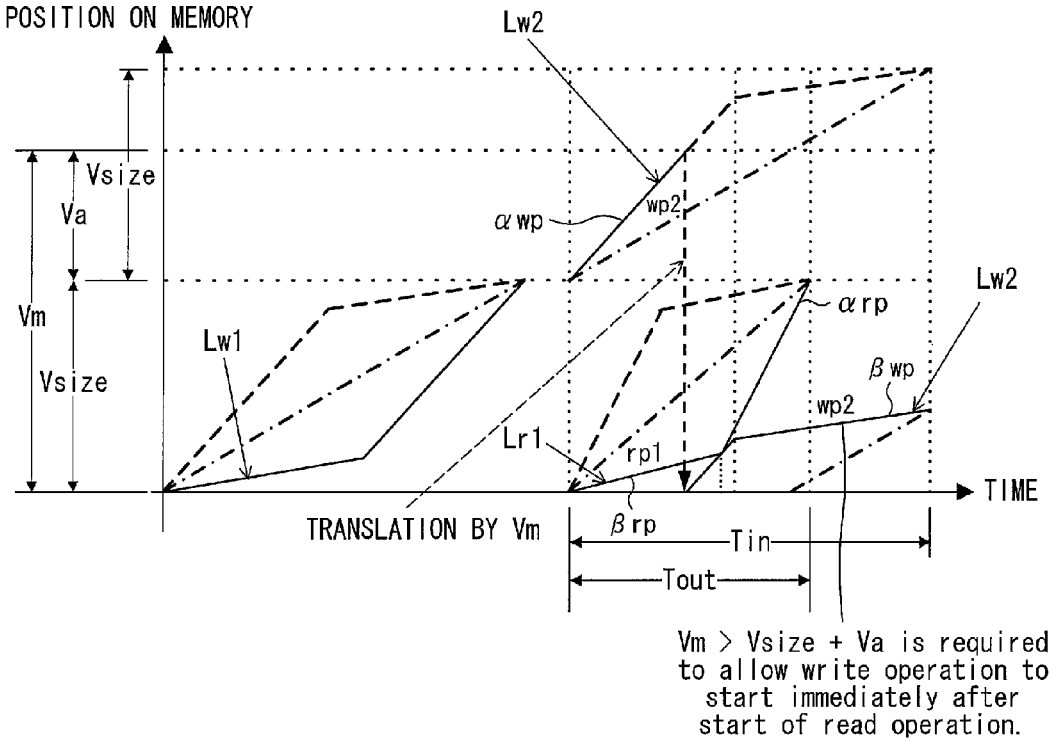
FIG. 7 is a graph illustrating how, in accordance with another mode of the present invention, image data is written into and read from a frame memory in a mode of the present invention in a case where a write time period Tin is longer than a read time period Tout.

FIG. 7 is a graph illustrating how image data is written into and read from the frame memory 31 in a case where the write time period Tin is longer than the read time period Tout. This case corresponds to a case in which the LCD controller 3 receives image data from the host processor 2 more slowly than the LCD controller 3 transfers image data to the LCD 4. FIG. 7 shows (i) a horizontal axis indicative of time and (ii) a vertical axis indicative of positions (addresses) on the frame memory 31. FIG. 7 shows that the frame memory 31 has a capacity Vm that is larger than the maximum size Vsize of compressed image data by the additional capacity Va.

As in the case of Embodiment 1 illustrated in FIG. 3, the output delay time period Outdly will prevent a read operation from overtaking a write operation. In other words, a read operation on image data is performed after a write operation on the same image data without causing tearing.

The description below deals with a case of, after starting reading image data for a first frame, writing image data for a subsequent second frame. This case assumes that the compression section 33 already ended writing the image data for the first frame (path Lw1) before the expansion section 34 starts reading the image data for the first frame. The (compressed) image data for the first frame and the (compressed) image data for the second frame each have a size of Vsize.

The expansion section 34 reads image data for a first frame most slowly in a case where the read pointer rp1 follows the path Lr1, on which the expansion section 34 begins reading image data at the minimum read rate βrp. The compression section 33 writes image data for a second frame most rapidly in a case where the write pointer wp2 follows the path Lw2, on which the compression section 33 begins writing image data at the maximum write rate αwp. FIG. 7 illustrates a case of, immediately after starting reading the image data for the first frame, starting writing the image data for the second frame. The compression section 33 starts a write operation on the image data for the second frame at the position at which the compression section 33 ended writing the image data for the immediately previous first frame. The compression section 33, in other words, starts a write operation on the image data for the second frame at a position on the memory which position follows Vsize. Since the image data for the second frame is larger than the additional capacity Va, the compression section 33, after writing the image data up to the last position (address) on the frame memory 31, continues writing the image data from the first position (address) on the frame memory 31. FIG. 7 virtually illustrates even a portion beyond the capacity Vm to help understand this case.

As illustrated in FIG. 7, in the case where the capacity Vm=Vsize+Va, the path Lr1 of the read pointer for the first frame in contact with the path Lw2 of the write pointer for the second frame at a time point, that is, the read pointer and the write pointer become coincident at a position at a time point. In a case where the capacity Vm>Vsize+Va, the write pointer wp2 for the second frame will not overtake the read pointer rp1 for the first frame, in other words, no tearing occurs.

In a case where the write time period Tin>the read time period Tout, the additional capacity Va in the formula below (Formula 3) may be calculated geometrically with reference to FIG. 7.

$$Va = \left(\alpha\frac{T_{out}}{T_{in}} - \beta\right)\frac{\alpha - 1}{\alpha - \beta}V_{size} \qquad \text{[Math. 3]}$$

In a case where, for instance, the compression method is such that α=41/24 and β=3/24, Va=(0.764 (Tout/Tin)−0.056) Vsize.

The capacity Vm of the frame memory 31 may thus be (i) larger than Vsize+Va and (ii) smaller than 2×Vsize. With this arrangement, the LCD controller 3, immediately after the expansion section 34 started a read operation on image data for a first frame, permits the compression section 33 to start a write operation on image data for a second frame. The above arrangement, in other words, prevents tearing without an inhibit time period, thereby permitting the host processor 2 to transfer data early. As described above, the present embodiment, on the basis of the range within which the read pointer rp1 may move and the range within which the write pointer wp2 may move, sets the capacity of the frame memory 31 so that the read pointer rp1 moving over the frame memory 31 most slowly for a first frame will not be overtaken by the write pointer wp2 moving over the frame memory 31 most rapidly for a second frame. The present embodiment, in other words, sets the capacity of the frame memory 31 so that the write pointer wp2 and the read pointer rp1 do not become coincident.

In the case where compressed image data has a size of the upper limit of Vsize, the read pointer for a first frame may be approached most closely by the write pointer for a second frame. Even in a case where compressed image data has a size of less than Vsize, no tearing occurs as long as the compression section 33 starts writing image data for a second frame after the expansion section 34 starts reading image data for a first frame.

The capacity of the frame memory 31 may have a margin of approximately 10%. For example, the capacity of the frame memory 31 may be set to (i) larger than Vsize+Va and (ii) not larger than (Vsize+Va)×11/10.

(Case of Write Time Period Tin<Read Time Period Tout)

Figure 8:
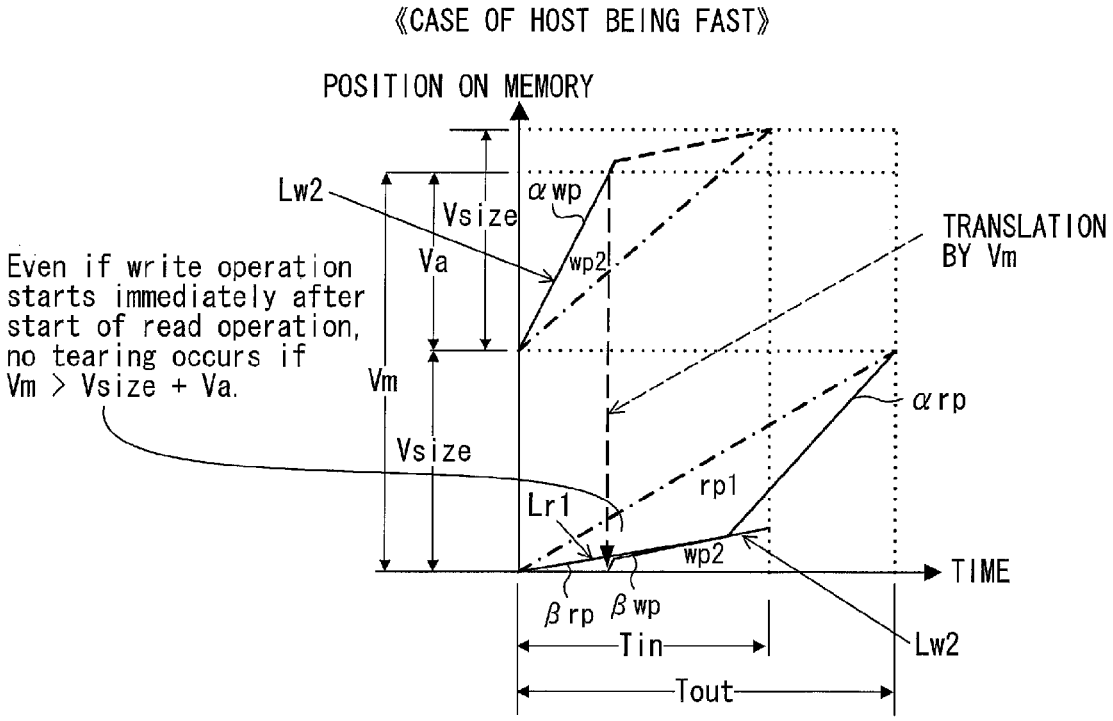
FIG. 8 is a graph illustrating how, in accordance with another mode of the present invention, image data is written into and read from a frame memory in a mode of the present invention in a case where a write time period Tin is shorter than a read time period Tout.

FIG. 8 is a graph illustrating how image data is written into and read from the frame memory 31 in a case where the write time period Tin is shorter than the read time period Tout. This case corresponds to a case in which the LCD controller 3 receives image data from the host processor 2 faster than the LCD controller 3 transfers image data to the LCD 4. FIG. 8 shows that the frame memory 31 has a capacity Vm that is larger than the maximum size Vsize of compressed image data by the additional capacity Va.

As in the case of Embodiment 1 illustrated in FIG. 5, a read operation will not overtake a write operation even in a case of starting a read operation immediately after starting a write operation. In other words, a read operation on image data is performed after a write operation on the same image data without causing tearing.

The description below deals with a case of, after starting reading image data for a first frame, writing image data for a subsequent second frame. This case assumes that the compression section 33 already ended writing the image data for the first frame before the expansion section 34 starts reading the image data for the first frame. The (compressed) image data for the first frame and the (compressed) image data for the second frame each have a size of Vsize.

The expansion section 34 reads image data for a first frame most slowly in a case where the read pointer rp1 follows the path Lr1, on which the expansion section 34 begins reading image data at the minimum read rate βrp. The compression section 33 writes image data for a second frame most rapidly in a case where the write pointer wp2 follows the path Lw2, on which the compression section 33 begins writing image data at the maximum write rate αwp. FIG. 8 illustrates a case of, immediately after starting reading the image data for the first frame, starting writing the image data for the second frame. The compression section 33 starts a write operation on the image data for the second frame at the position at which the compression section 33 ended writing the image data for the immediately previous first frame. The compression section 33, in other words, starts a write operation on the image data for the second frame at a position on the memory which position follows Vsize. Since the image data for the second frame is larger than the additional capacity Va, the compression section 33, after writing the image data up to the last position (address) on the frame memory 31, continues writing the image data from the first position (address) on the frame memory 31. FIG. 8 virtually illustrates even a portion beyond the capacity Vm to help understand this case.

As illustrated in FIG. 8, in the case where the capacity Vm=Vsize+Va, the path Lr1 of the read pointer for the first frame in contact with the path Lw2 of the write pointer for the second frame at a time point, that is, the read pointer and the write pointer become coincident at a position at a time point. In a case where the capacity Vm>Vsize+Va, the write pointer wp2 for the second frame will not overtake the read pointer rp1 for the first frame, in other words, no tearing occurs.

In a case where the write time period Tin<the read time period Tout, the additional capacity Va in the formula below (Formula 4) may be calculated geometrically with reference to FIG. 8.

$$Va = \left(1 - \beta - \beta\frac{\alpha - 1}{\alpha - \beta} + \beta\frac{\alpha - 1}{\alpha - \beta}\frac{T_{in}}{T_{out}}\right)V_{size} \quad \text{[Math. 4]}$$

In a case where, for instance, the compression method is such that $\alpha$=41/24 and $\rho$=3/24, Va=(0.764 (Tout/Tin)−0.056) Vsize.

The capacity Vm of the frame memory 31 may thus be (i) larger than Vsize+Va and (ii) smaller than 2×Vsize. With this arrangement, the LCD controller 3, immediately after the expansion section 34 started a read operation on image data for a first frame, permits the compression section 33 to start a write operation on image data for a second frame. The above arrangement, in other words, prevents tearing without an inhibit time period, thereby permitting the host processor 2 to transfer data early.

In the case where compressed image data has a size of the upper limit of Vsize, the read pointer for a first frame may be approached most closely by the write pointer for a second frame. Even in a case where compressed image data has a size of less than Vsize, no tearing occurs as long as the compression section 33 starts writing image data for a second frame after the expansion section 34 starts reading image data for a first frame.

[Summary of Critical Time Period Td and Additional Capacity Va]

FIG. 9 is a table that summarizes the relationships between (i) the critical time period Td and additional capacity Va described for the embodiments above and (ii) Tin and Tout. FIG. 9 shows, for comparison, examples in which image data is not compressed (that is, the image data is uncompressed) before being written into the frame memory. Note here that since uncompressed image data means image data that is not compressed, Vsize in the rows for uncompressed image data (that is, the size of uncompressed image data) is larger than Vsize in the rows for compressed image data (that is, the size of compressed image data). Specifically, uncompressed image data, in the first place, requires a larger capacity than compressed image data for storage of single-frame image data even in a case where the additional capacity Va is 0.

[Variations of Write Inhibition During Inhibit Time Period Ts]

The description below deals with variations of write inhibition during the inhibit time period Ts with reference to FIGS. 12 through 14.

The example above uses the TE signal to inhibit a write operation. The description below deals with its variations.

A write operation may be inhibited by arranging predetermined sequence control between the host processor 2 and LCD controller 3 shown in FIG. 1 to delay, until the inhibit time period Ts passes, transmitting and receiving permission information in response to request information described below.

The term "predetermined sequence control" refers to control under which (i) the LCD controller 3 transmits request information, which serves to request the start of a write operation, to the host processor 2, (ii) the host processor 2 transmits permission information, which serves to permit the start of a write operation, to the LCD controller 3, and then (iii) the host processor 2 starts transferring image data to the LCD controller 3. Specific examples include control for causing the host processor 2 and the LCD controller 3 to wait to start image data transfer from the host processor 2 to the LCD controller 3 through (i) sequence control based on polling (handshake flag) by the control register 35, (ii) sequence control based on a bus turnaround (BTA) function in an MIPI command mode, (iii) sequence control based on a REQ (request) signal and/or ACK (acknowledge) signal, (iv) sequence control based on a HVBLK pulse signal, which does not change (toggle) during the inhibit time period Ts, (v) sequence control based on a HVBLK level signal for notification of the inhibit time period Ts with use of a level, or (vi) sequence control based on an asynchronous bus wait function for a case of an asynchronous bus.

The term "polling" refers to a communication mode or process mode of, in communication or software, sequentially and regularly polling a plurality of devices or programs and if a certain condition is satisfied, carrying out data transmission/receipt or data processing to prevent contention, determine (monitor) whether the device or program is ready for data transmission and receipt, and/or synchronize different processes.

Examples of the request information and permission information include the above-mentioned handshake flag, bus turnaround (BTA), REQ signal/ACK signal, HVBLK pulse signal, and HVBLK level signal. The description below deals in detail with these examples of the request information and permission information.

(Handshake Flag)

The host processor 2, when it is to transfer image data, changes the value of the handshake flag of the control register 35 from 0 to 1 and transmits request information to the LCD controller 3. Upon receipt of the request information, the LCD controller 3, when it has become ready for data transfer from the host processor 2, changes the handshake flag of the control register 35 from 1 back to 0 and transmits permission information to the host processor 2. The host processor 2, after transmitting the request information, monitors the handshake flag of the control register 35 through polling, and when the host processor 2 has recognized receipt of the permission information, starts transferring image data to the LCD controller 3. Normally, adjusting the time period between (i) a time point at which the value of the handshake flag is set to 1 and (ii) a time point at which the value of the handshake flag is set back to 0 can delay the time point of the start of a write operation (that is, the time point of the start of display serial interface [DSI] input), that is, such adjustment can inhibit a write operation.

Figure 12:
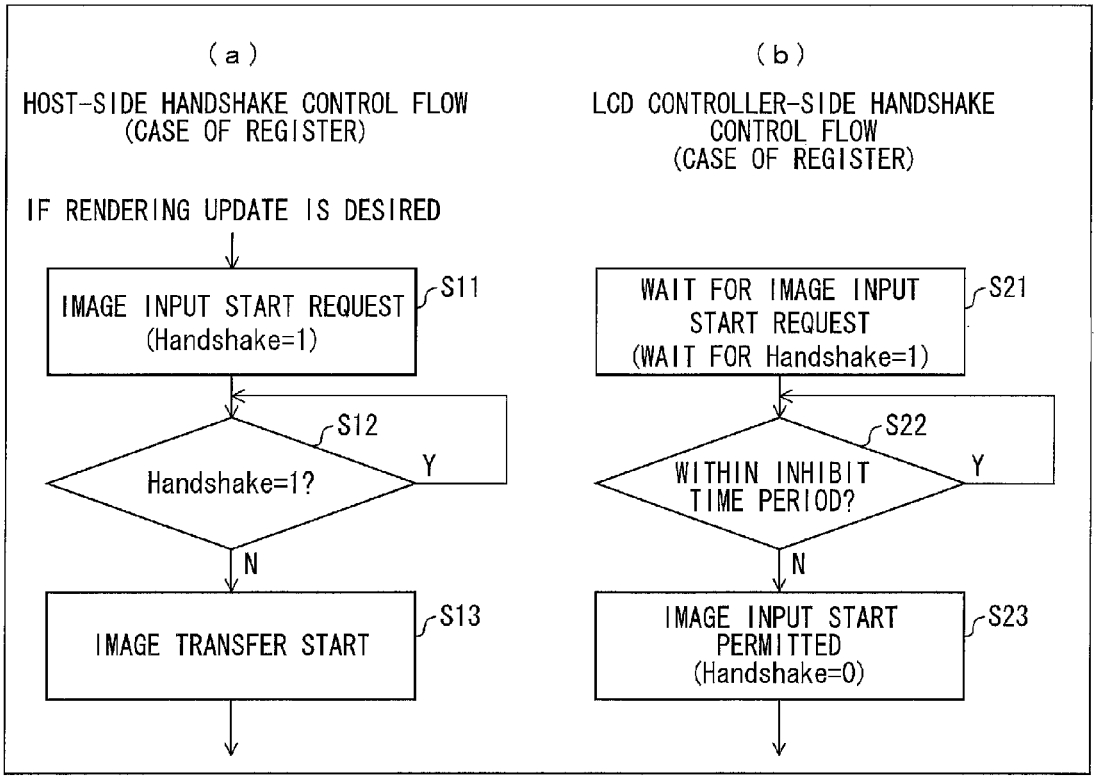
FIG. 12 shows flowcharts each illustrating example handshake control on the side of a host processor or LCD controller, where (a) is a flowchart illustrating example handshake control on the side of a host processor (for a case of a control register), and (b) is a flowchart illustrating example handshake control on the side of an LCD controller (for a case of a control register).

(a) of FIG. 12 is a flowchart illustrating example handshake control on the side of the host processor 2 (for the case of the control register 35). (b) of FIG. 12 is a flowchart illustrating example handshake control on the side of the LCD controller 3 (for the case of the control register 35).

As illustrated in (a) of FIG. 12, if a software program on the host processor 2 needs to update image data (rendering update), the flow starts at S11. At S11, the host processor 2 changes the value of the handshake flag of the control register 35 from 0 to 1 and transmits request information to the LCD controller 3. The flow then proceeds to S12.

At S12, the host processor 2 checks whether the handshake flag has a value of 1. If the handshake flag has a value of 1, the flow repeats S12. If the handshake flag does not have a value of 1 (that is, has a value of 0), the flow proceeds to S13, where the host processor 2 starts transferring image data to the LCD controller 3.

Next, as illustrated in (b) of FIG. 12, the LCD controller 3 waits at S21 to receive request information for writing image data (handshake flag=1). If the LCD controller 3 has received request information, the flow proceeds to S22.

At S22, the delay control section 32 inhibits a write operation before the inhibit time period Ts passes, so that the flow repeats S22 (YES). The delay control section 32, once the inhibit time period Ts has passed, permits a write operation. The flow then proceeds to S23 (NO).

At S23, the control register 35 sets the value of the handshake flag to 0, and permits the host processor 2 to transfer image data.

(BTA)

The host processor 2, when it is to transfer image data, concedes a bus turnaround to the LCD controller 3 with use of a BTA function, and transmits request information to the LCD controller 3. Upon receipt of the request information, the LCD controller 3, when it has become ready for data transfer from the host processor 2, transmits a TE (tearing effect) event to the host processor 2, returns the bus turnaround to the host processor 2, and transmits permission information to the host processor 2. The host processor 2, when it has recognized receipt of the permission information, starts data transfer.

Figure 13:
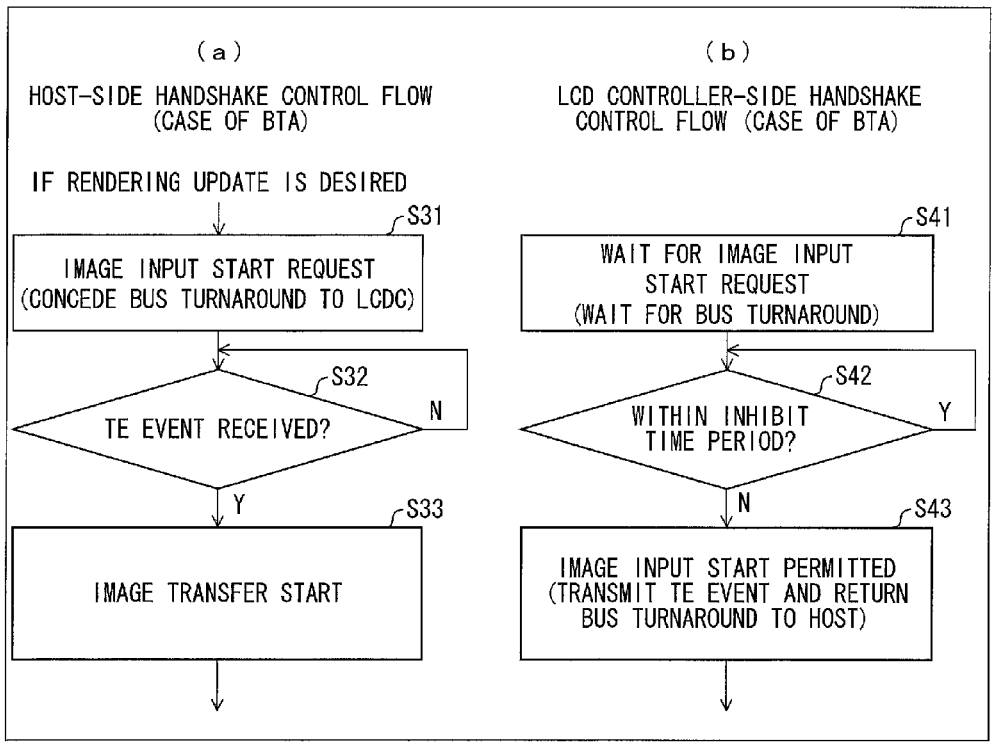
FIG. 13 shows flowcharts each illustrating example handshake control on the side of a host processor or LCD controller, where (a) is a flowchart illustrating example handshake control on the side of a host processor (for a case of BTA), and (b) is a flowchart illustrating example handshake control on the side of an LCD controller (for a case of BTA).

(a) of FIG. 13 is a flowchart illustrating example handshake control on the side of the host processor 2 (for the case of BTA). (b) of FIG. 13 is a flowchart illustrating example handshake control on the side of the LCD controller 3 (for the case of BTA).

As illustrated in (a) of FIG. 13, if a software program on the host processor 2 needs to update image data (rendering update), the flow starts at S31. At S31, the host processor 2 concedes a bus turnaround to the LCD controller 3. The flow then proceeds to S32.

At S32, the host processor 2 checks whether it has received a TE event from the LCD controller 3. If the host processor 2 has received a TE event from the LCD controller 3, the flow proceeds to S33 (YES). If the host processor 2 has not received a TE event from the LCD controller 3, the flow repeats S32.

At S33, the host processor 2 starts transferring image data to the LCD controller 3.

Next, as illustrated in (b) of FIG. 13, the LCD controller 3 waits at S41 to receive a bus turnaround from the host processor 2. The flow then proceeds to S42.

At S42, the delay control section 32 inhibits a write operation before the inhibit time period Ts passes, so that the flow repeats S42 (YES). The delay control section 32, once the inhibit time period Ts has passed, permits a write operation. The flow then proceeds to S43 (NO).

At S43, the LCD controller 3 transmits a TE event to the host processor 2 and returns the bus turnaround to the host processor 2.

(REQ Signal/ACK Signal)

Figure 14:
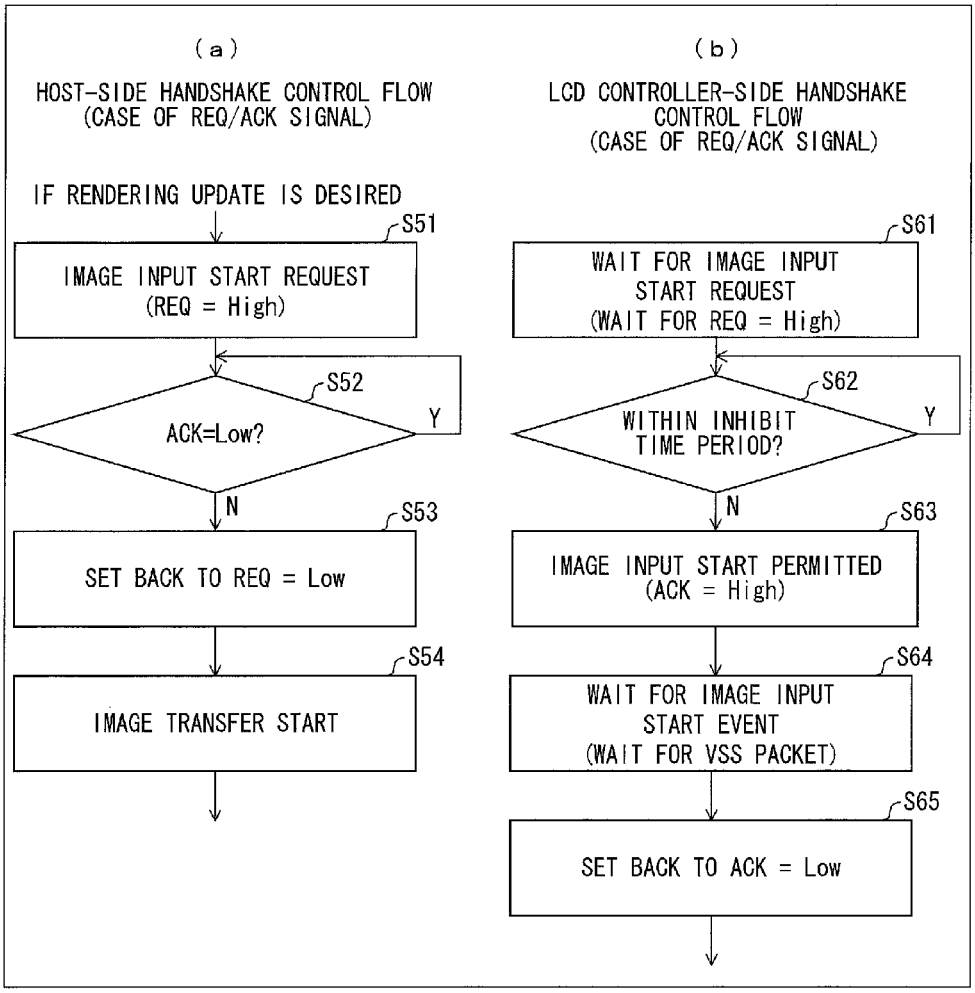
FIG. 14 shows flowcharts each illustrating example handshake control on the side of a host processor or LCD controller, where (a) is a flowchart illustrating example handshake control on the side of a host processor (for a case of a REQ signal/ACK signal), and (b) is a flowchart illustrating example handshake control on the side of an LCD controller (for a case of a REQ signal/ACK signal).

With reference to FIG. 14, the description below now deals with a flow of handshake control involving a REQ signal/ACK signal.

(a) of FIG. 14 is a flowchart illustrating example handshake control on the side of the host processor 2 (for the case of the REQ signal/ACK signal). (b) of FIG. 14 is a flowchart illustrating example handshake control on the side of the LCD controller 3 (for the case of the REQ signal/ACK signal).

As illustrated in (a) of FIG. 14, if a software program on the host processor 2 needs to update image data (rendering update), the flow starts at S51. At S51, the host processor 2 sets the REQ signal to a high (REQ=High) level and transmits the REQ signal to the LCD controller 3. The flow then proceeds to S52.

At S52, the host processor 2 checks whether the ACK signal received from the LCD controller 3 has a low level (ACK=Low). If ACK=Low, the flow repeats S52 (YES). If ACK≠Low (that is, ACK=High), the flow proceeds to S53 (NO).

At S53, the host processor 2 sets the REQ signal back to REQ=Low. The flow then proceeds to S54.

At S54, the host processor 2 starts transferring image data to the LCD controller 3.

Next, as illustrated in (b) of FIG. 14, the LCD controller 3 waits at S61 to receive from the host processor 2 a REQ signal having a high level (REQ=High). The flow then proceeds to S62.

At S62, if the LCD controller 3 has received REQ=High from the host processor 2, the delay control section 32 inhibits a write operation before the inhibit time period Ts passes, so that the flow repeats S62 (YES). The delay control section 32, once the inhibit time period Ts has passed, permits a write operation. The flow then proceeds to S63 (NO).

At S63, the LCD controller 3 sets the ACK signal to a high (ACK=High) level and transmits the ACK signal to the host processor 2. The flow then proceeds to S64.

At S64, the LCD controller 3 waits to receive a VSS packet from the host processor 2. The flow then proceeds to S65.

At S65, the LCD controller 3 sets the ACK signal back to a low (ACK=Low) level.

(HVBLK Pulse Signal)

The LCD controller 3 outputs, at a predetermined cycle, a single HVBLK pulse signal having an extremely short time period between a rise to a high level and a fall to a low level. The LCD controller 3 keeps the HVBLK pulse signal high before the inhibit time period Ts passes, and sets the HVBLK pulse signal back to a low level after the inhibit time period Ts passes. The host processor 2 checks the level of the HVBLK pulse signal to wait for an edge (fall) of the HVBLK pulse signal, and if the host processor 2 has confirmed an edge (low level), starts transferring image data.

(HVBLK Level Signal)

The LCD controller 3 keeps the HVBLK level high before the inhibit time period Ts passes, and after the inhibit time period Ts passes, outputs a HVBLK level signal having a low level. The host processor 2 polls (monitors) the LCD controller 3 for the HVBLK level, and if the HVBLK level is low, starts transferring image data.

[Recap]

A memory control device (LCD controller 3) according to mode 1 of the present invention is a memory control device, including: a frame memory (31) having a predetermined recording capacity; a compression section (33) for (i) compressing image data for a single frame, the image data being transferred from a host (host processor 2), into a size not larger than the recording capacity and (ii) writing the compressed image data into the frame memory; an expansion section (34) for (i) reading the compressed image data from the frame memory, (ii) expanding the compressed image data, and (iii) transferring the expanded image data to a display control section (LCD 4); and a timing control section (delay control section 32) for, until an inhibit time period Ts passes from a start of reading compressed image data for a first frame, inhibiting a start of writing compressed image data for a second frame subsequent to the first frame, the inhibit time period Ts being so preset as to prevent coincidence between a range of a move of a read position over the frame memory and a range of a move of a write position over the frame memory.

The above arrangement makes it possible to prevent tearing even in such a case where image data is compressed to be recorded in a frame memory.

A memory control device according to mode 2 of the present invention is arranged as in mode 1 above, and may be further arranged such that the inhibit time period Ts is so preset that the read position for the compressed image data for the first frame which read position moves over the frame memory most slowly is not overtaken by the write position for the compressed image data for the second frame which write position moves over the frame memory most rapidly.

A memory control device according to mode 3 of the present invention is arranged as in mode 1 or 2 above, and may be further arranged such that the compression section has (i) a maximum write rate that is $\alpha$ times an average write rate and (ii) a minimum write rate that is $\beta$ times the average write rate; the expansion section has (i) a maximum read rate that is $\alpha$ times an average read rate and (ii) a minimum read rate that is $\beta$ times the average read rate; the compression section writes the compressed image data for the single frame over a fixed write time period Tin; the expansion section reads the compressed image data for the single frame over a fixed read time period Tout; and the inhibit time period Ts is (i) not shorter than a critical time period Td and (ii) shorter than the read time period Tout, the critical time period Td being, in a case where Tin>Tout, represented by [Math. 1] above, and, in a case where Tin<Tout, represented by [Math. 2] above.

The above arrangement makes it possible to prevent tearing even in such a case where image data is compressed to be recorded in a frame memory while the inhibit time period Ts is shorter than the read time period Tout.

A memory control device according to mode 4 of the present invention is arranged as in any one of modes 1 to 3 above, and may be further arranged such that the compression section compresses the image data for the single frame into a size not larger than an upper limit value Vsize; and the predetermined recording capacity is not smaller than Vsize and not larger than Vsize×11/10.

The above arrangement allows the frame memory to have a minimally required recording capacity.

A memory control device according to mode 5 of the present invention is a memory control device, including: a frame memory having a predetermined recording capacity; a compression section for (i) compressing image data for a single frame, the image data being transferred from a host, into a size not larger than an upper limit value Vsize and (ii) writing the compressed image data into the frame memory; and an expansion section for (i) reading the compressed image data from the frame memory, (ii) expanding the compressed image data, and (iii) transferring the expanded image data to a display control section, the predetermined recording capacity of the frame memory being so set as to prevent coincidence between a range of a move of a read position over the frame memory and a range of a move of a write position over the frame memory.

The above arrangement makes it possible to prevent tearing even in such a case where image data is compressed to be recorded in a frame memory.

A memory control device according to mode 6 of the present invention is arranged as in mode 5 above, and may be further arranged such that the compression section starts writing compressed image data for a second frame at a position that follows a position at which the compression section ended writing compressed image data for a first frame immediately previous to the second frame; and the predetermined recording capacity of the frame memory is so set that the read position for the compressed image data for the first frame which read position moves over the frame memory most slowly is not overtaken by the write position for the compressed image data for the second frame which write position moves over the frame memory most rapidly.

A memory control device according to mode 7 of the present invention is arranged as in mode 5 or 6 above, and may be further arranged such that the compression section has (i) a maximum write rate that is $\alpha$ times an average write rate and (ii) a minimum write rate that is $\beta$ times the average write rate; the expansion section has (i) a maximum read rate that is $\alpha$ times an average read rate and (ii) a minimum read rate that is $\beta$ times the average read rate; the compression section writes the compressed image data for the single frame over a fixed write time period Tin; the expansion section reads the compressed image data for the single frame over a fixed read time period Tout; and the predetermined recording capacity of the frame memory is (i) larger than a sum of Vsize and an additional capacity Va and (ii) smaller than twice Vsize, the additional capacity Va being a recording capacity that is, in a case where Tin>Tout, represented by [Math. 3] above, and, in a case where Tin<Tout, represented by [Math. 4] above.

The above arrangement makes it possible to prevent tearing even in such a case where image data is compressed to be recorded in a frame memory while the predetermined recording capacity of the frame memory is smaller than twice Vsize.

A memory control device according to mode 8 of the present invention is arranged as in mode 7 above, and may be further arranged such that the predetermined recording capacity of the frame memory is (i) larger than Vsize+Va and (ii) not larger than (Vsize+Va)×11/10.

The above arrangement allows the frame memory to have a minimally required recording capacity.

A memory control device according to mode 9 of the present invention is arranged as in mode 1 or 6 above, and may be further arranged such that the compression section starts writing the compressed image data for the second frame at a position on the frame memory which position is near a position at which the compression section ended writing the compressed image data for the first frame.

The above arrangement allows the frame memory to be used efficiently, and thus allows the frame memory to have a small size.

A mobile terminal according to mode 10 of the present invention is a mobile terminal, including a memory control device according to any one of modes 1 to 9.

The present invention is not limited to the description of the embodiments above, but may be altered in various ways by a skilled person within the scope of the claims. Any embodiment based on a proper combination of technical means disclosed in different embodiments is also encompassed in the technical scope of the present invention. Further, combining technical means disclosed in different embodiments can provide a new technical feature.

INDUSTRIAL APPLICABILITY

The present invention is applicable to a memory control device and a mobile terminal.

REFERENCE SIGNS LIST

1 image transfer system
2 host processor (host)
3 LCD controller (memory control device)
4 LCD (display control section)
10 mobile terminal
31 frame memory
32 delay control section (timing control section)
33 compression section
34 expansion section
35 control register

The invention claimed is:

1. A memory control device, comprising:

a frame memory having a predetermined recording capacity;

a compression section for (i) compressing image data for a single frame, the image data being transferred from a host, into a size not larger than the recording capacity and (ii) writing the compressed image data into the frame memory;

an expansion section for (i) reading the compressed image data from the frame memory, (ii) expanding the compressed image data, and (iii) transferring the expanded image data to a display control section; and a timing control section for, until an inhibit time period Ts passes from a start of reading compressed image data for a first frame, inhibiting a start of writing compressed image data for a second frame subsequent to the first frame, the inhibit time period Ts being so preset as to prevent coincidence between a range of a move of a read position over the frame memory and a range of a move of a write position over the frame memory; wherein the inhibit time period Ts is not shorter than a critical time period Td and is shorter than a read time period Tout, the critical time period Td being a time period preset so as to prevent coincidence between a range of a move of a read position over the frame memory and a range of a move of a write position over the frame memory provided that a write rate of writing by the compression section is variable between a minimum write rate and a maximum write rate and a read rate of reading by the expansion section is variable between a minimum read rate and a maximum read rate, and the read time period Tout being a fixed time period over which the expansion section reads the compressed image data for the single frame.

2. The memory control device according to claim 1, wherein the inhibit time period Ts is so preset that the read position for the compressed image data for the first frame which read position moves over the frame memory most slowly is not overtaken by the write position for the compressed image data for the second frame which write position moves over the frame memory most rapidly.

3. The memory control device according to claim 1, wherein:

the compression section has (i) a maximum write rate that is $\alpha$ times an average write rate and (ii) a minimum write rate that is $\beta$ times the average write rate;

the expansion section has (i) a maximum read rate that is $\alpha$ times an average read rate and (ii) a minimum read rate that is $\beta$ times the average read rate;

the compression section writes the compressed image data for the single frame over a fixed write time period Tin;

the expansion section reads the compressed image data for the single frame over the read time period Tout; and the inhibit time period Ts is (i) not shorter than the critical time period Td and (ii) shorter than the read time period Tout, the critical time period Td being, in a case where Tin>Tout, represented by $$\frac{\alpha-1}{\alpha-\beta}T_{out}-\frac{\beta}{\alpha}\cdot\frac{\alpha-1}{\alpha-\beta}T_{in}, \quad \text{[Math. 1]}$$

and, in a case where Tin<Tout, represented by $$\left(1-\frac{1}{\alpha}+\frac{1-\beta}{\alpha-\beta}\right)T_{out}-\frac{1-\beta}{\alpha-\beta}T_{in}. \quad \text{[Math. 2]}$$

4. The memory control device according to claim 1, wherein:

the compression section compresses the image data for the single frame into a size not larger than an upper limit value Vsize, the Vsize being a maximum size of compressed image data; and the predetermined recording capacity is not smaller than the Vsize and not larger than the Vsize×11/10.

5. The memory control device according to claim 1, wherein the compression section starts writing the compressed image data for the second frame at a position on the frame memory which position is near a position at which the compression section ended writing the compressed image data for the first frame.

6. A mobile terminal, comprising a memory control device according to claim 1.

7. A memory control device, comprising:

a frame memory having a predetermined recording capacity;

a compression section for (i) compressing image data for a single frame, the image data being transferred from a host, into a size not larger than an upper limit value Vsize, the Vsize being a maximum size of compressed image data, and (ii) writing the compressed image data into the frame memory; and an expansion section for (i) reading the compressed image data from the frame memory, (ii) expanding the compressed image data, and (iii) transferring the expanded image data to a display control section, wherein the predetermined recording capacity of the frame memory being so set as to prevent coincidence between a range of a move of a read position over the frame memory and a range of a move of a write position over the frame memory; and the predetermined recording capacity of the frame memory is larger than a sum of the Vsize and an additional capacity Va and is smaller than twice the Vsize, the additional capacity Va being a recording capacity preset so as to prevent coincidence between a range of a move of a read position over the frame memory and a range of a move of a write position over the frame memory provided that a write rate of writing by the compression section is variable between a minimum write rate and a maximum write rate and a read rate of reading by the expansion section is variable between a minimum read rate and a maximum read rate.

8. The memory control device according to claim 7, wherein:

the compression section starts writing compressed image data for a second frame at a position that follows a position at which the compression section ended writing compressed image data for a first frame immediately previous to the second frame; and the predetermined recording capacity of the frame memory is so set that the read position for the compressed image data for the first frame which read position moves over the frame memory most slowly is not overtaken by the write position for the compressed image data for the second frame which write position moves over the frame memory most rapidly.

9. The memory control device according to claim 7, wherein:

the compression section has (i) a maximum write rate that is α times an average write rate and (ii) a minimum write rate that is β times the average write rate;

the expansion section has (i) a maximum read rate that is α times an average read rate and (ii) a minimum read rate that is β times the average read rate;

the compression section writes the compressed image data for the single frame over a fixed write time period Tin;

the expansion section reads the compressed image data for the single frame over a fixed read time period Tout; and the predetermined recording capacity of the frame memory is (i) larger than the sum of the Vsize and the additional capacity Va and (ii) smaller than twice the Vsize, the additional capacity Va being a recording capacity that is, in a case where Tin>Tout, represented by $$\left(\alpha\frac{T_{out}}{T_{in}}-\beta\right)\frac{\alpha-1}{\alpha-\beta}V_{size}, \quad \text{[Math. 3]}$$

and, in a case where Tin<Tout, represented by $$\left(1-\beta-\beta\frac{\alpha-1}{\alpha-\beta}+\beta\frac{\alpha-1}{\alpha-\beta}\frac{T_{in}}{T_{out}}\right)V_{size}. \quad \text{[Math. 4]}$$

10. The memory control device according to claim 9, wherein the predetermined recording capacity of the frame memory is (i) larger than the Vsize+the Va and (ii) not larger than (the Vsize+the Va)×11/10.

* * * * *